US008687029B2

(12) United States Patent
Huang

(10) Patent No.: US 8,687,029 B2
(45) Date of Patent: Apr. 1, 2014

(54) METHOD FOR REDUCING RIPPLE NOISE OF A DISPLAY IMAGE

(75) Inventor: Chang-Xin Huang, Taipei (TW)

(73) Assignee: Chunghwa Picture Tubes, Ltd., Bade, Taoyuan County (TW)

( * ) Notice: Subject to any disclaimer, the term of this patent is extended or adjusted under 35 U.S.C. 154(b) by 708 days.

(21) Appl. No.: 12/981,537

(22) Filed: Dec. 30, 2010

(65) Prior Publication Data

US 2012/0044282 A1 Feb. 23, 2012

(30) Foreign Application Priority Data

Aug. 18, 2010 (TW) ..... 99127632 A

(51) Int. Cl.
*G09G 5/10* (2006.01)

(52) U.S. Cl.
USPC ..... 345/691; 345/690; 315/360

(58) Field of Classification Search
None
See application file for complete search history.

(56) References Cited

U.S. PATENT DOCUMENTS

2005/0206589 A1 9/2005 Miyachi et al.
2006/0203525 A1 * 9/2006 Yu et al. ..... 363/97

* cited by examiner

*Primary Examiner* — Crystal L Hammond
(74) *Attorney, Agent, or Firm* — Chih Feng Yeh; Huntington IP Consulting Co., Ltd

(57) ABSTRACT

The present invention discloses a method for reducing ripple noise on the image of a display. The steps of the method include: (a) providing a first potential signal to a backlight module by an inverter; (b) resetting the inverter; (c) providing a second potential signal to the backlight by the inverter, wherein the phase difference between the first potential signal and the second potential signal is 180 degrees; (d) resetting again the inverter; and (e) repeating the steps (a) to (d) Consequently, the ripple noise present on the display would be effectively reduced by the alteration of the bright areas and dark areas on the display panel in conjunction with the persistence of vision of the user's eyes.

10 Claims, 11 Drawing Sheets

METHOD FOR REDUCING RIPPLE NOISE OF A DISPLAY IMAGE

CROSS-REFERENCE TO RELATED APPLICATION

This present application claims priority to TAIWAN Patent Application Serial Number 099127632 filed on Aug. 18, 2010, which is herein incorporated by reference.

TECHNICAL FIELD

The present invention relates to a method for reducing ripple noise of the display image; in particular, a method of resetting an inverter by a timing controller during each signal transmission to the display panel so that the voltage of the backlight lamp is kept constant with time, thereby reducing the ripple noise present in the display image.

BACKGROUND OF THE RELATED ART

Traditionally, an LCD (Liquid Crystal Display) panel is illuminated by a backlight module for increasing the screen bright of the LCD panel to enhance the display quality.

FIG. 1 illustrates a driving architecture of a backlight module of a conventional LCD. As shown in FIG. 1, an inverter 101 is used to supply a potential to each lamp 111, 113, 115 and 117 of the backlight module 110 to switch on these lamps. The potential outputted from the inverter 101 is a sine wave wherein the voltage varies as a function of time, whereas the output frequency is constant. As such, the signal transmitted from the inverter 101 through the backlight module 110 to the LCD panel would result in the ripple noise where an interference noise would be periodically generated on the display image.

The cause of the ripple noise is briefly summarized herein. Generally, the voltage supplied to the backlight module 110 (such as lamps 111, 113, 115 and 117) is much greater than the voltage for driving each pixel of the LCD panel. Therefore, the voltage of each pixel of the LCD panel is interfered by the voltage supplied from the inverter 101 to the backlight module 110. In this case, the potential of each pixel corresponding to the respective lamps 111, 113, 115 and 117 of the backlight module 110 would exhibit a potential distribution having a sine waveform along the longitudinal direction, thereby generating dark band(s) on the display image. As shown in FIG. 2A, the dark bands 210 are appeared on the LCD panel 200.

Generally, the potential difference between the adjacent dark bands 210 is quite small, and therefore, the dark bands 210 instantaneously appeared on the image are not readily perceived by the user with naked eyes. Yet, according to the display principle of the LCD panel 200, a timing controller (not shown in figure) is used for sequentially providing potential to each pixel of the LCD panel 200, from top to bottom.

As described hereinabove, the potential supplied from the inverter 101 to the backlight module 110 would propagate as a sine wave. As such, if the image illustrated in FIG. 2A is the image displayed by the LCD panel 200 at the $1^{st}$ second, then, at the $2^{nd}$ second, since the supplied potential capable of affecting the potential of each pixel of the LCD panel 210 would propagate downward, the image displayed by the LCD panel 200 would be the one illustrated in FIG. 2B, wherein the dark band 211 is located under the dark band 210 shown in FIG. 2A. As discussed hereinabove, the dark band 210 (or 211) shown on the momentary image would not be perceived by a user with naked eyes. Yet, when the images are displayed continuously, the dark band appeared to be moving downward, for example, the position of the dark band shifts from the dark band 210 to the dark band 211 shown in FIG. 2C, thereby resulting in the ripple noise that could be perceived by a user with naked eyes. As such, the image quality of the LCD would be deteriorated.

Therefore, a driving architecture of the backlight module of the LCD is disclosed in U.S. Pat. No. 6,417,833, entitled "Liquid Crystal Display Apparatus and Method for Lighting Backlight thereof". FIG. 3 is a schematic diagram illustrating such driving architecture. The first inverter 103 outputs potential driving voltage to the lamp 1111 and the lamp 1113, and the second inverter 105 outputs potential driving voltage to the lamp 1115 and the lamp 1117. In the instant example, the potentials outputted from the first inverter 103 and the second inverter 105 have a phase difference of 180 degrees; that is, a positive-potential high voltage is applied to the lamp 1111 and 1113, whereas a negative-potential high voltage is applied to the lamp 1115 and 1117. As such, the dark bands generated by the lamp 1113 and 1115 are offset by the compensation provided by the 180-degree phase difference. However, the instant architecture is not able to effectively reduce the dark bands generated between the lamps 1111 and 1113 and between the lamps 1115 and 1117. Moreover, during the startup of the lamps, the high voltage difference between the positive and negative potentials simultaneously generated by two adjacent lamps may cause the problem of flashover.

An improvement to the driving architecture illustrated in FIG. 3 is disclosed in Taiwan Patent No. I240599, entitled "Lamp Module and Backlight Module", wherein an alternative arrangement is provided to reduce the chances where the positive and negative potentials are neighboring, thereby reducing the probability of the flashover. However, although the driving architecture disclosed in this patent can reduce the chance of the flashover, a dark band would still be generated when the potentials of two adjacent lamps have the same phases. In other words, if the voltages received by the adjacent lamps have the same phases, a dark band would be generated.

In view of the foregoing, the prior art fails to effectively reduce the ripple noise of a display image of the LCD panel caused by the driving inverter of the backlight module.

Accordingly, there exists a need in the art for a method for reducing the ripple noise of the display image of an LCD panel caused by the interference of the potential outputted from the driving inverter of the backlight module. Also, the method is capable of improving the display quality of the LCD without substantially altering the driving architecture of the LCD.

SUMMARY

One object of the present invention is to resolve the ripple noise present in a display image of the LCD panel caused by the interference resulted from the potential outputted from the driving inverter of the backlight module of the LCD.

Another object of the present invention is to resolve the flashover caused by using an inverter for applying a positive-potential and a negative-potential high voltage to adjacent lamps simultaneously.

For achieving objects mentioned above, one embodiment of the present invention provides a method for reducing ripple noise on a display image. The method comprises the following steps: (a) a first potential signal is supplied to a backlight module by an inverter; (b) the inverter is reset; (c) a second potential signal is supplied to the backlight by the inverter, wherein the first potential signal and the second potential signal have the same phase; and (d) the steps (b) to (c) are repeated. As such, since the first potential signal and the second potential signal have the same phase, the positions of the dark bands present in the image shown on the display panel would not change with time. Therefore, the dark bands would not be readily perceived by the user with naked eyes. In other words, the present method effectively reduces the ripple noise in the display image by improving the problem of the downward movement of the dark bands. In this embodiment, the inverter is coupled to a timing controller for resetting a timing sequence of the inverter, wherein the resetting step is performed during the transmission of the image to the display panel. Moreover, the backlight module of the present embodiment comprises a plurality of lamps, and each of the lamps receives the first and second potential signals from the inverter. For example, the first and second potential signals can be a sine wave signal.

In an alternative embodiment, the present invention provides a method for reducing the ripple noise on a display image. The method comprises the following steps: (a) a first potential signal is supplied to a backlight by an inverter; (b) the inverter is reset; (c) a second potential signal is supplied to the backlight by the inverter, wherein the phase difference between the first potential signal and the second potential signal is 180 degrees; (d) the inverter is reset again; and (e) the steps (a) to (d) are repeated. Consequently, the ripple noise present on the display would be effectively reduced by the alteration of the bright areas and dark areas on the display panel in conjunction with the persistence of vision of the user's eyes.

Similarly, in this embodiment, the inverter is coupled to a timing controller for resetting a timing sequence of the inverter. In addition, the backlight module of the present embodiment comprises a plurality of lamps, and each of the lamps receives the first and second potential signals, wherein the first potential signal is a sine wave signal, and the second potential signal is a sine wave signal having a phase difference of 180 degree with respect to the first sine wave signal.

As discussed hereinabove, the present methods for reducing the ripple noise in the display image of the present invention may effectively reduce the ripple noise resulted from the interference caused by the high voltage outputted from the inverter to the backlight module. Besides, the conventional problem of the flashover may be avoided by not simultaneously outputting a positive-potential high voltage and a negative-potential high voltage to two adjacent lamps.

These merits given in the following embodiments and with reference to the accompanying drawings and claims will become apparent clearly to the reader.

DETAILED DESCRIPTION

The detailed description provided below in connection with the appended drawings is intended as a description of the preferred embodiments and is not intended to represent the only forms in which the present embodiments may be constructed or utilized. The description sets forth the functions of the example and the sequence of steps for constructing and operating the embodiments. However, the same or equivalent functions and sequences may be accomplished by different examples.

In accordance with common practice, the various described elements are not drawn to scale but are drawn to illustrate specific elements relevant to the present invention. Like reference numbers and designations in the various drawings indicate like elements.

The present invention discloses a method for reducing the ripple noise on a display image by using a timing controller to reset an inverter while transmitting signal to the display panel in the aim to keep the potential of the backlight lamp constant with time to reducing the ripple noise in the image.

Figure 1:
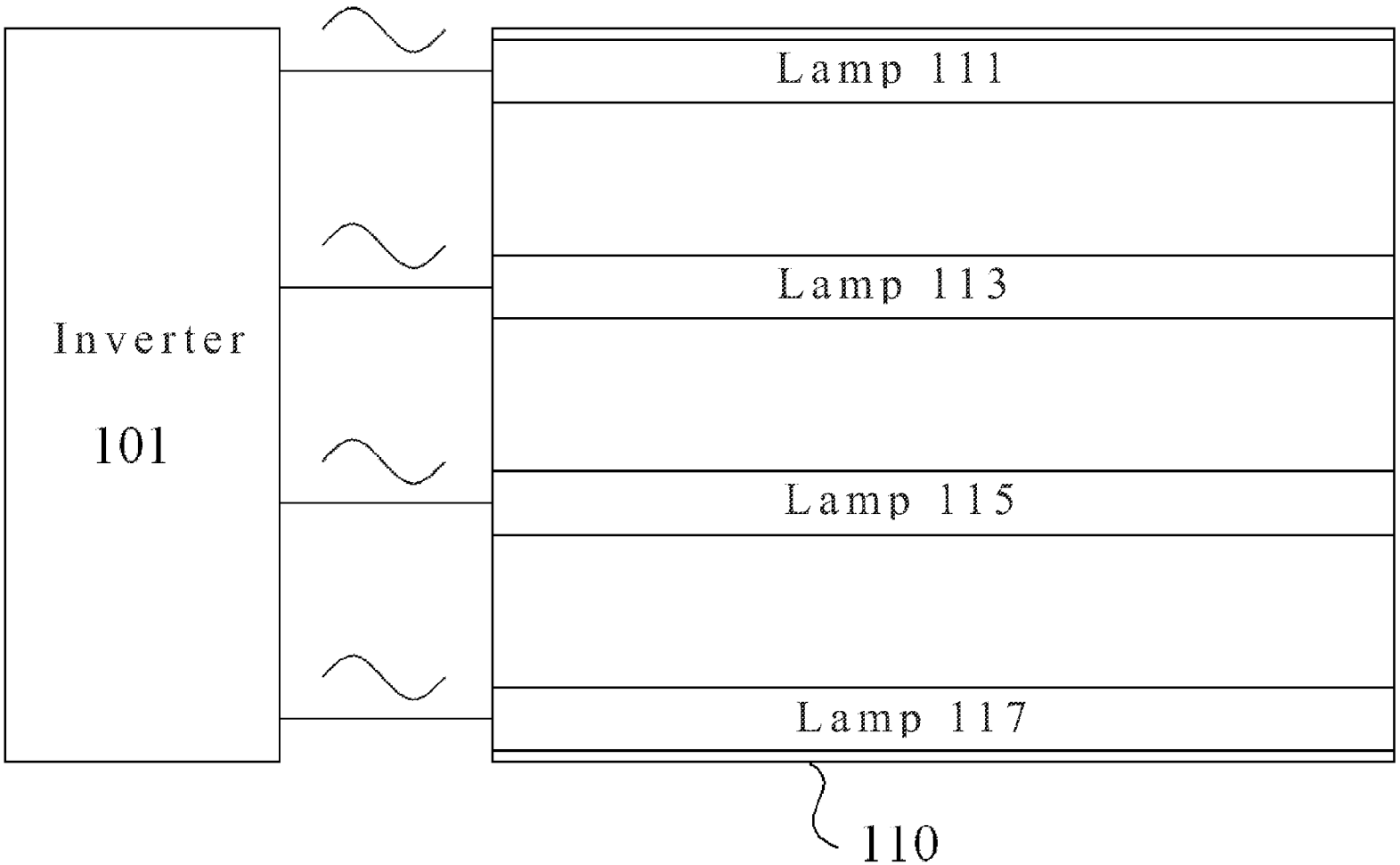
FIG. 1 (Prior art)
FIG. 1 is a schematic diagram illustrating a driving architecture of the conventional backlight module of the LCD.
Figure 2A:
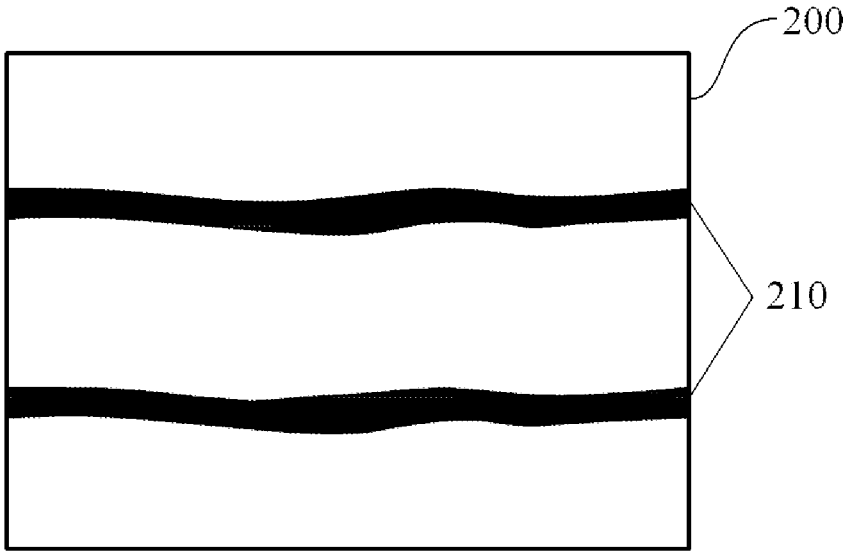
FIG. 2A (Prior art)
FIGS. 2A-2C are schematic diagrams illustrating the ripple noise present in the image of the conventional LCD.
Figure 2B:
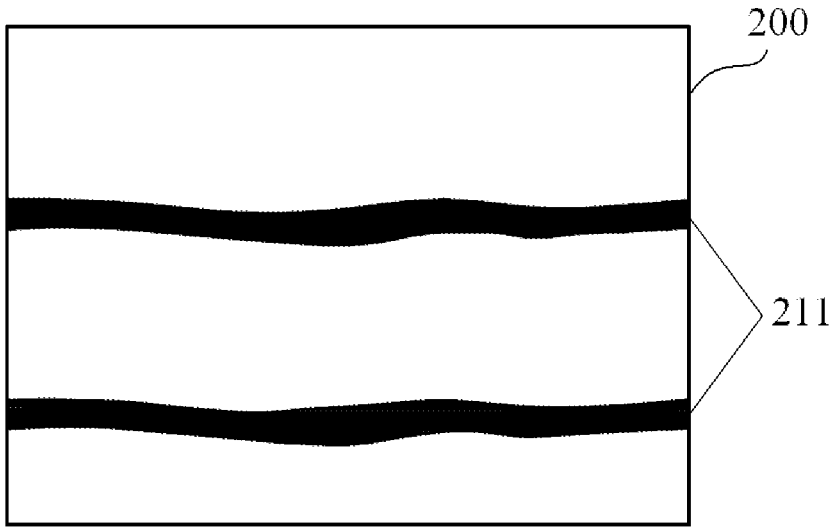
FIG. 2B (Prior art)
Figure 2C:
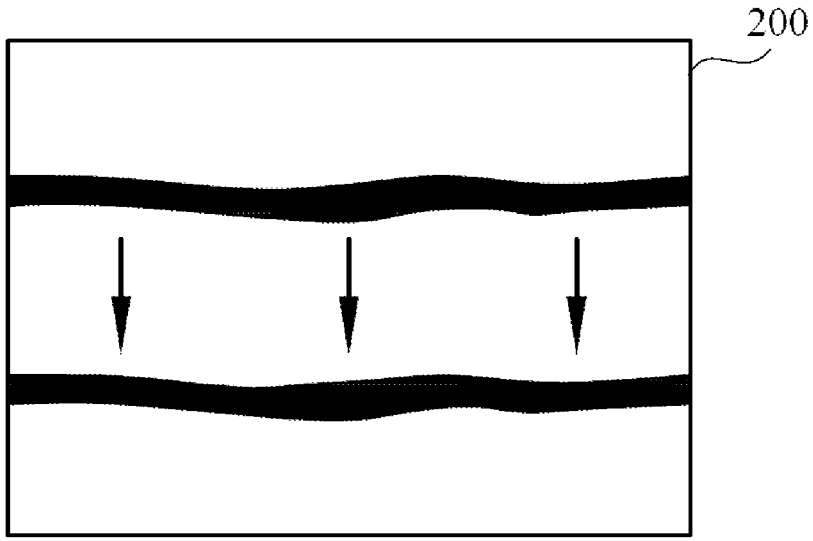
FIG. 2C (Prior art)
Figure 3:
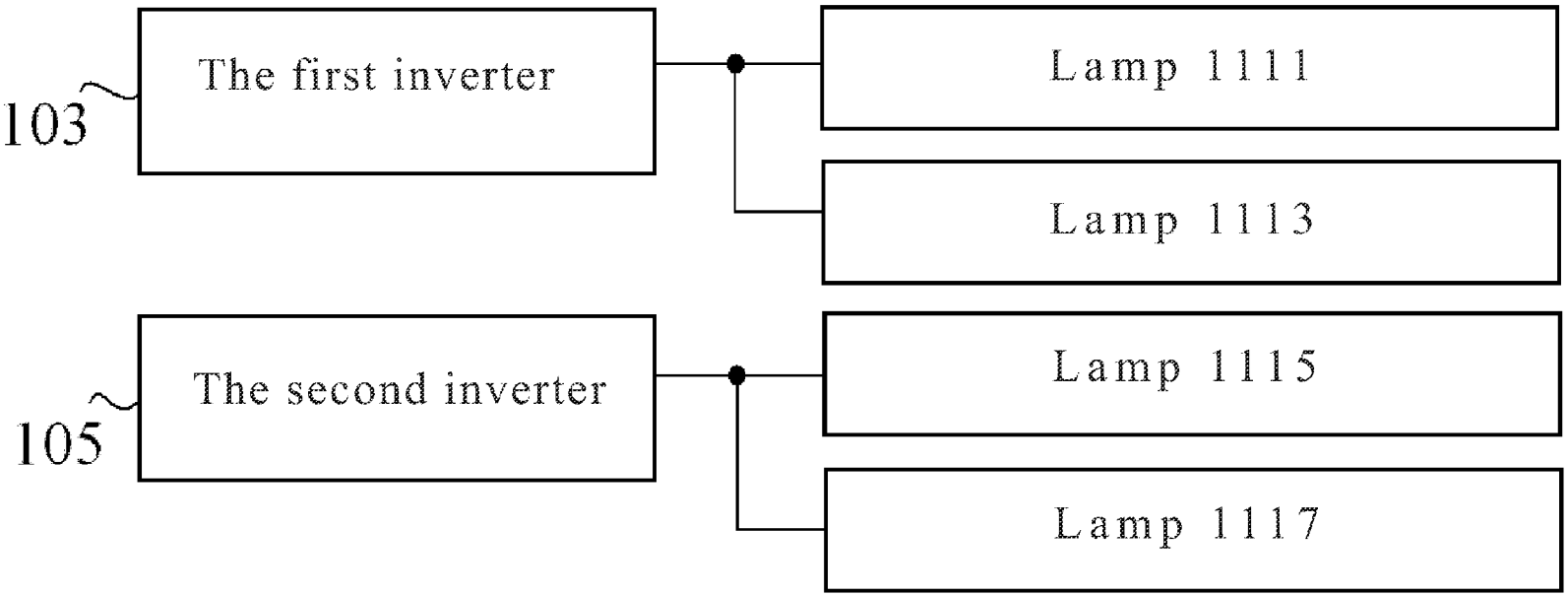
FIG. 3 (Prior art)
FIG. 3 is a schematic diagram illustrating a conventional driving architecture of the backlight module of the LCD for resolving the ripple noise.
Figure 4:
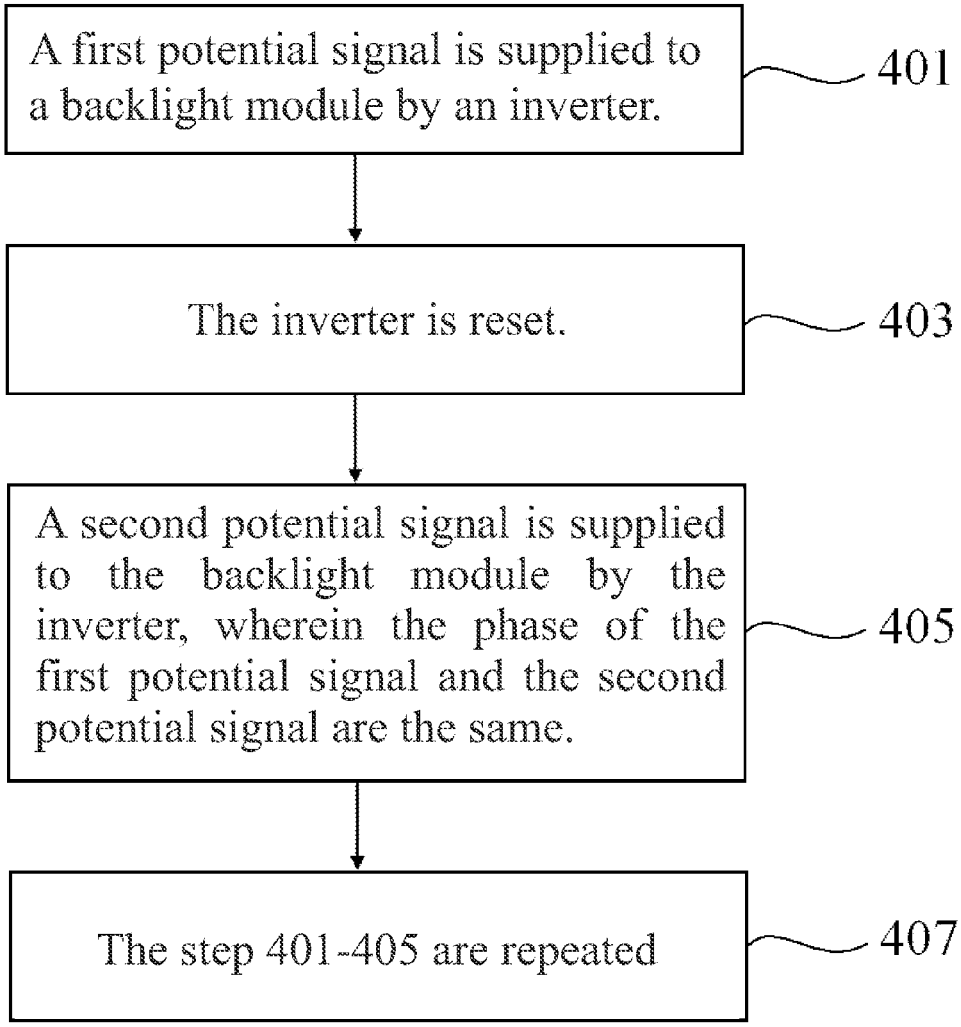
FIG. 4 is a flow chart illustrating a method for reducing the ripple noise according to one embodiment of the present invention.
Figure 5:
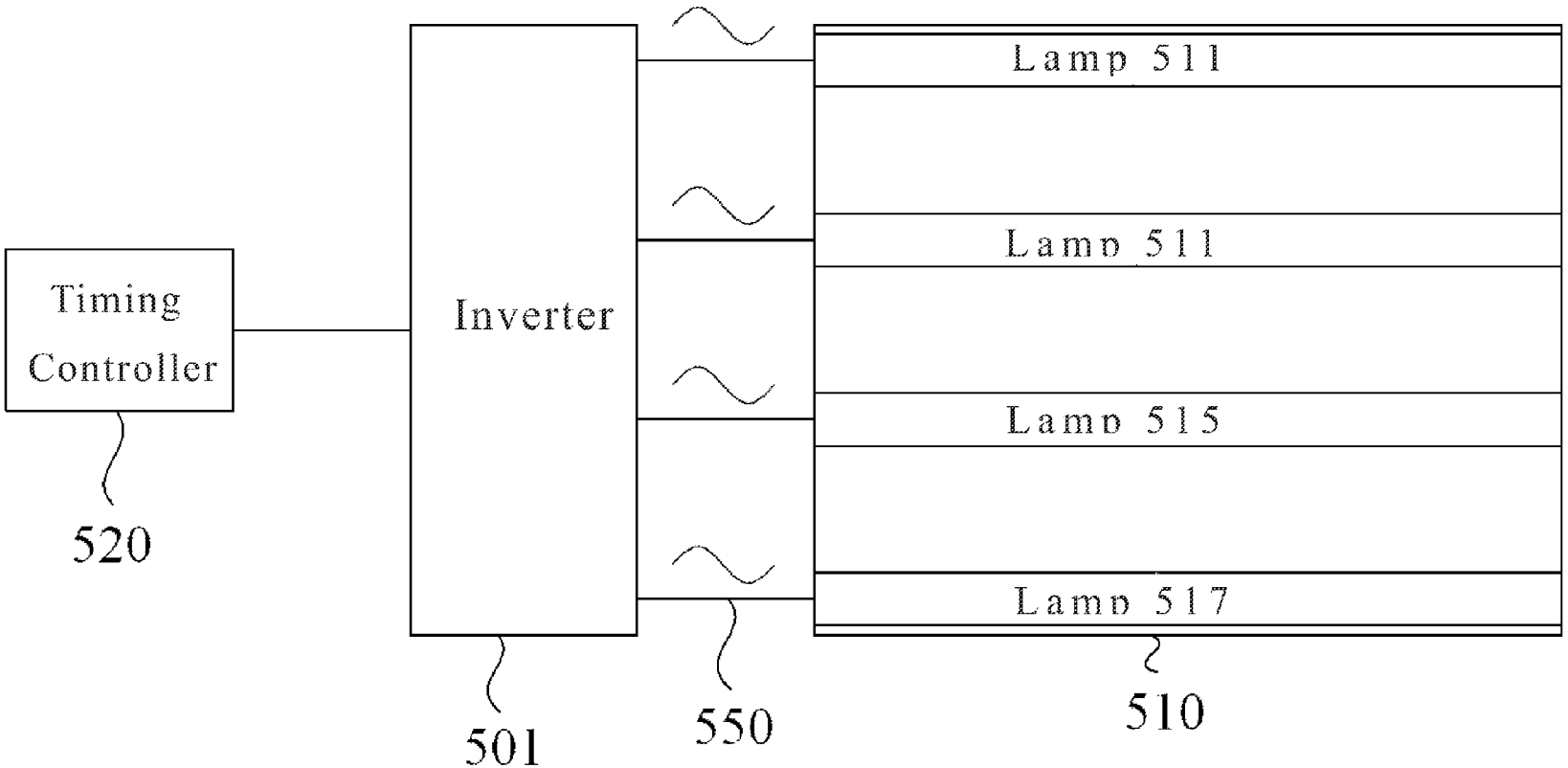
FIG. 5 is a schematic diagram illustrating a driving architecture of the backlight module of the LCD for resolving ripple noise in accordance with the present invention.
Figure 6A:
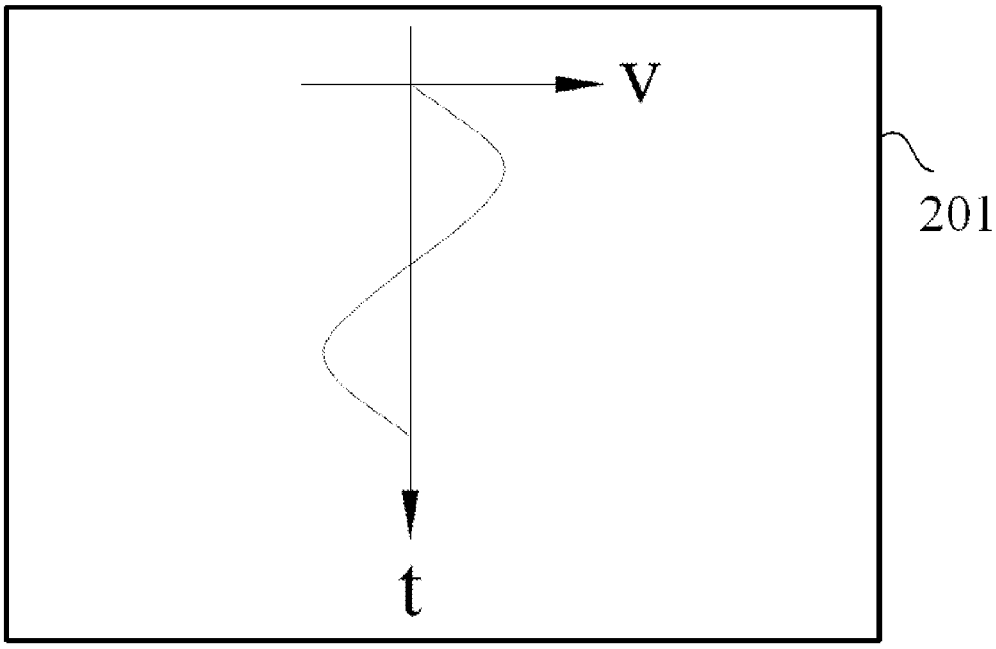
FIGS. 6A-6B are schematic diagrams illustrating the mechanism of the method for reducing the ripple noise according to the embodiment discussed with FIG. 5.
Figure 6B:
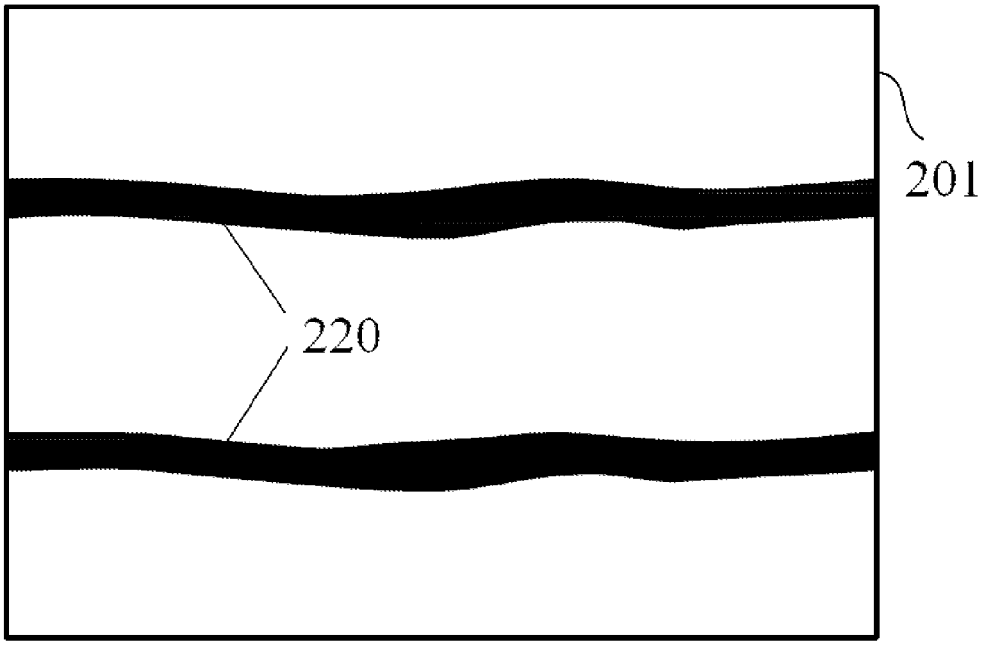

Reference is now made to FIG. 4 to FIG. 6B. FIG. 4 is a flow chart illustrating a method for reducing the ripple noise according to one embodiment of the present invention, and FIG. 5, FIG. 6A, and FIG. 6B are schematic diagrams illustrating the architecture and mechanism used in the present embodiment.

First, in step 401, an inverter 501 supplies the first potential signal to a backlight module 510. The display used here is a liquid crystal display, the structural components of which are well known to those with ordinary skill in the art and are not the features relevant to the present invention; as such, detailed descriptions thereof are omitted for the sake of clarity.

In this embodiment, the backlight module 510 comprises a plurality of lamps 511-517, and the inverter 501 is coupled to the backlight module 510, namely. That is, the inverter 501 is coupled to the lamps 511-517 respectively. Potential signals 550 are respectively transmitted to the lamps 511-517 by inverter while the backlight module 510 is driven.

The potential signal 550 supplied by the inverter 501 is a sine wave (see also, FIG. 6A) and the voltage transmitted to the lamps 511-517 is much greater than the driving voltage of the LCD panel 201. As such, when the backlight module 510 is switched on, the voltage transmitted to the lamps 511-517 would be interfered by the sine wave, thereby generating dark bands 220 on the display panel 201, as shown in FIG. 6B.

As discussed hereinabove, such dark bands 220 are not readily perceived by the user with unaided-eyes, since the potential difference between the adjacent dark bands 220 is quite small.

It should be noted that only four lamps are illustrated in the figures to describe the present embodiment, the present invention is not limited thereto, or rather the embodiments according to the present invention may employ more or less lamps in the backlight module 510.

Thereafter, aforesaid inverter 501 is reset in step 403.

Next, in step 405, a second potential signal having the same phase as the first potential signal is transmitted to the lamps 511-517 of the backlight module 510 through the inverter 501.

As shown in FIG. 5, the inverter 501 is coupled to a timing controller 520. Hence, the timing controller 520 is operable to control the timing of the steps 403 and 405.

In some embodiments, the timing controller 520 is operable to synchronize the resetting of the inverter 501 with the transmission of an image signal to the display panel 201. That is, when the inverter 501 transmits a first potential signal 550 to the backlight module 510, the timing controller 520 correspondingly transmits a first image signal to each pixel of the display panel 201 from top to bottom; then, when the timing controller 520 transmits a second image signal, the timing controller 520 synchronously transmits a timing signal for resetting the inverter 501 to the inverter 501 for controlling the inverter 501 and then transmits a second potential signal 550 to the backlight module 510.

In this way, the timing of the receipt of the image signals by the display panel 201 is synchronized with the timing of the transmission of the potential signals 550 from the inverter 501 to the lamps 511-517 of the backlight module 510. In other words, whenever the timing controller 520 outputs an image signal to the display panel 201, it would simultaneously reset the inverter 501 so that the next potential signal (for example, the second potential signal) outputted by the reset inverter would have the same phase as previous one (for example, the first potential signal). As such, during the interval between the first and second outputs, the interference waveform from the backlight module 510 and the dark bands resulted therefore are the same as the waveform and dark bands as illustrated in FIG. 6A and FIG. 6B.

Then, in step 407, the steps 401-405 are repeated. As such, each potential signal outputted by the inverter would have the waveform as shown in FIG. 6A, and the dark bands resulted therefore would be kept at the same position on the display as shown in FIG. 6B. Hence, the dark bands shown on the display would not move downward with time, therefore the ripple noise present would not be readily perceived by the user with naked-eye. As such, despite the presence of the dark bands, the image quality of the display would be substantially improved by using the present method.

Figure 7:
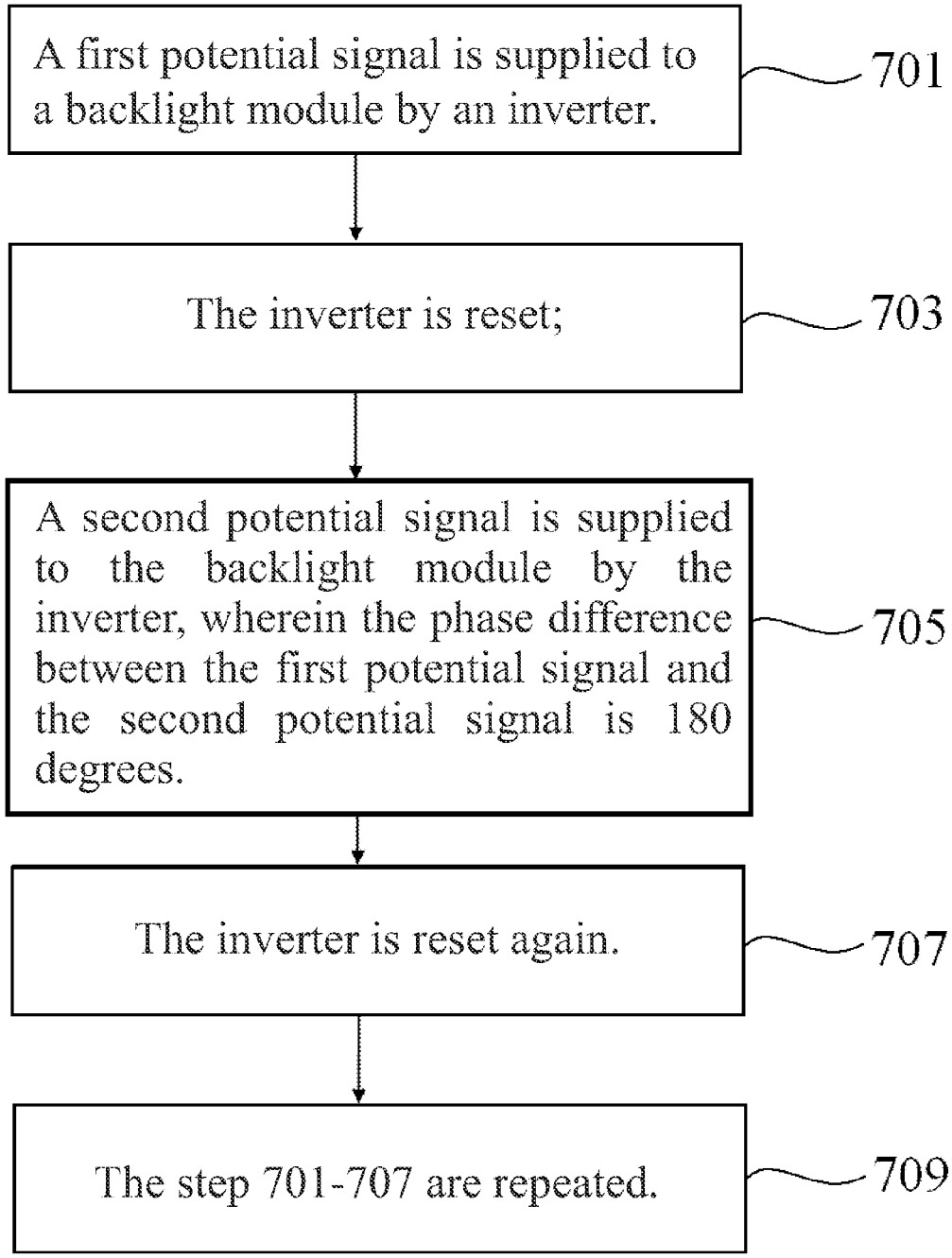
FIG. 7 is a flow chart illustrating an a method for reducing the ripple noise according to another embodiment of the present invention.
Figure 8A:
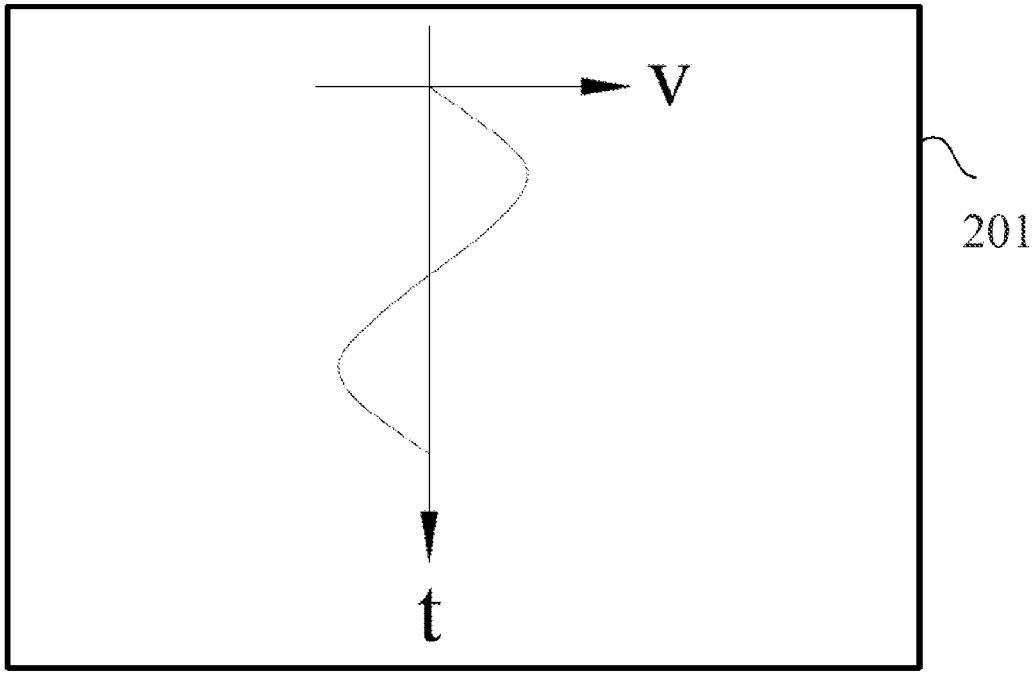
FIGS. 8A-8E are schematic diagrams illustrating the mechanism of the method for reducing the ripple noise according the embodiment discussed with FIG. 7.
Figure 8B:
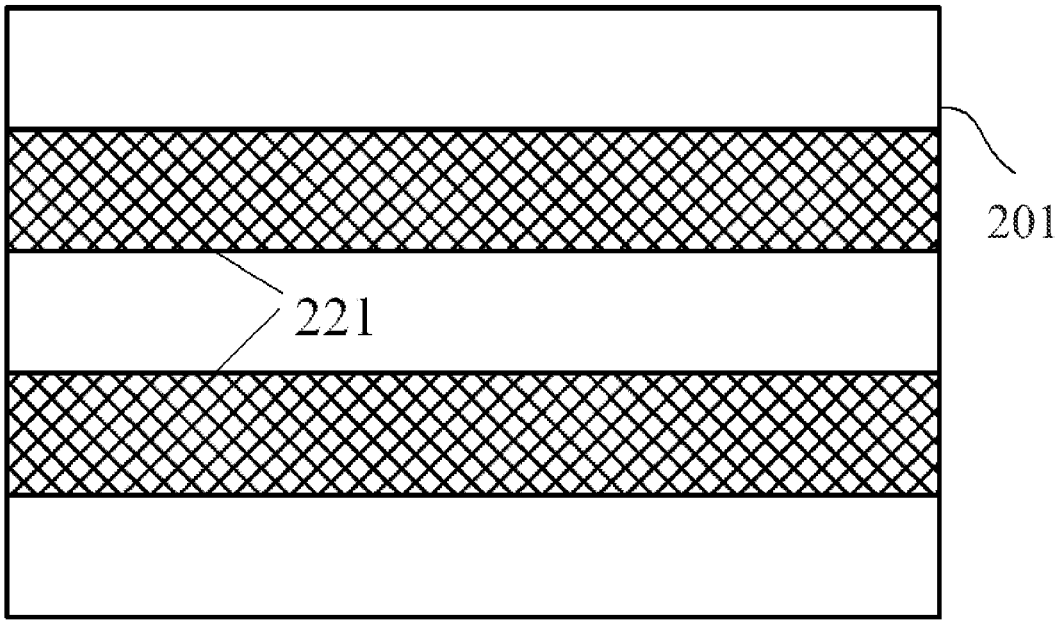
Figure 8C:
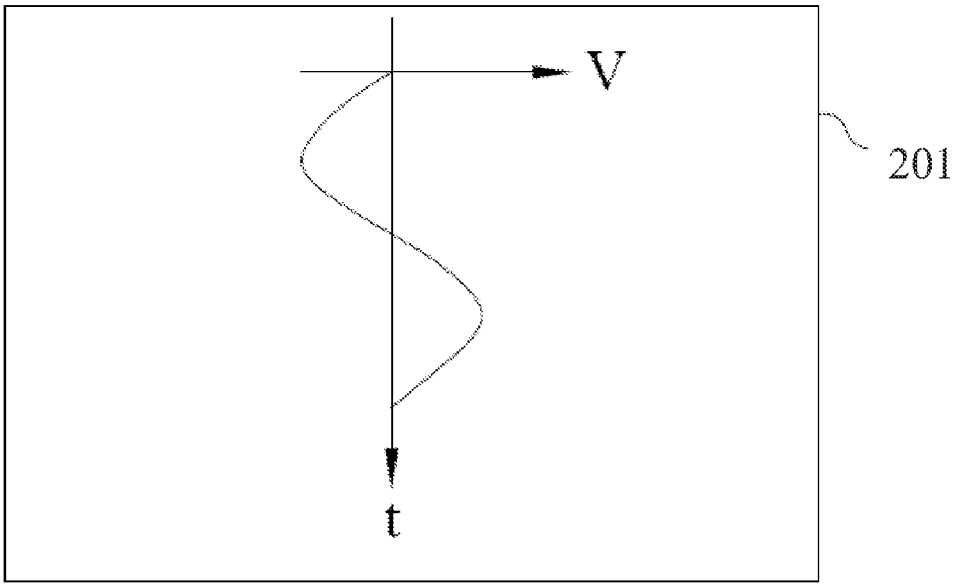
Figure 8D:
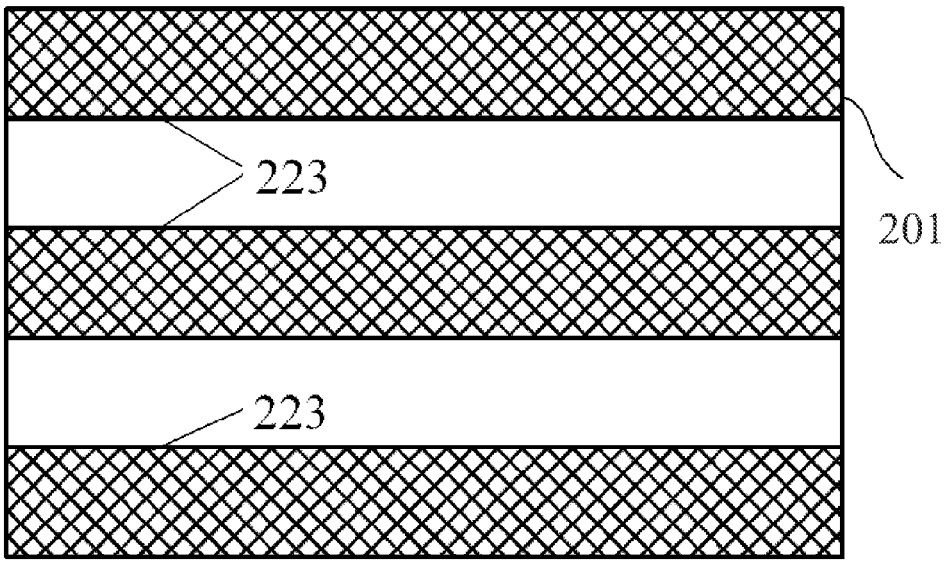
Figure 8E:
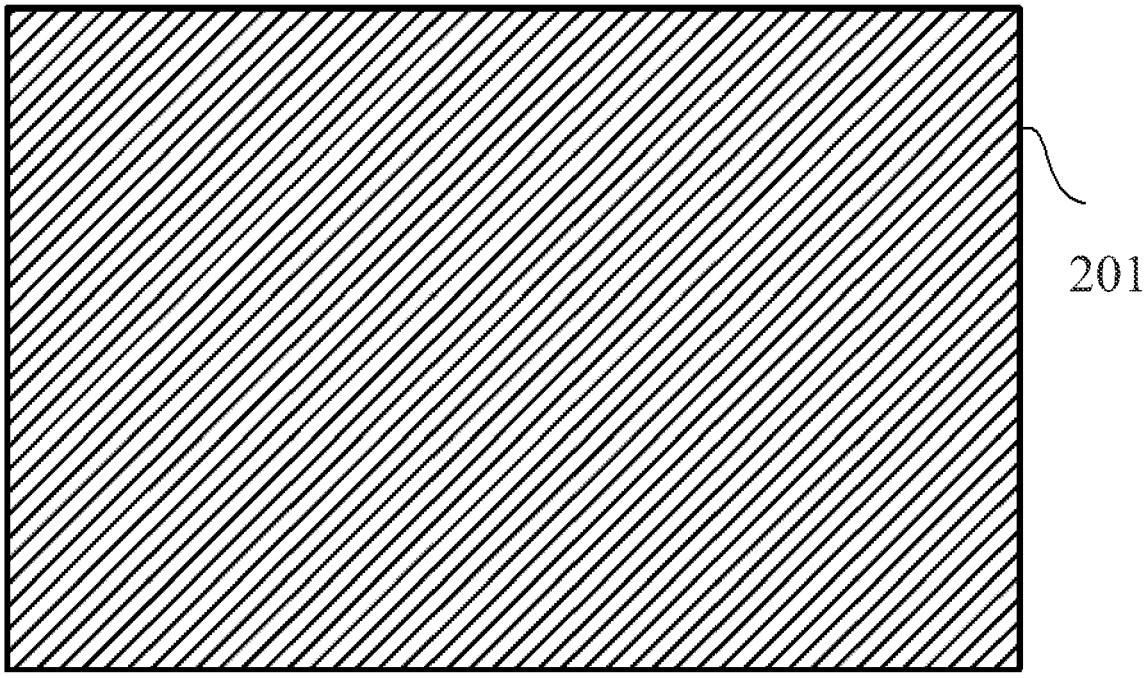

Reference is now made to FIG. 7 to FIG. 8E. FIG. 7 is a flow chart illustrating a method for reducing the ripple noise according to another embodiment of the present invention, and FIG. 8A to FIG. 8E are schematic diagrams illustrating the architecture and mechanism used in the present embodiment. As would be clear from the discussion herein below, the present embodiment may further reduce the dark bands to further improve the image quality.

First, in step 701, an inverter 501 supplies a first potential signal to a backlight module 510. Similarly, the inverter 501 is coupled to a plurality of lamps 511-517. While driving the backlight module 510, the inverter 501 transmits the potential signals 550 to the plural lamps 511-517 respectively. Since the potential signal 550 supplied from the inverter 501 is a sine wave signal and the voltage transmitted to the lamps 511-517 is much greater than the driving voltage of the LCD panel 201, when the backlight module 510 is switched on, the voltage transmitted to the lamps 511-517 would interfere the image of display panel 201 (as shown in FIG. 8A), thereby resulting in the dark bands 221 as shown in FIG. 8B. As described herein above, those dark bands, if being kept at the same position on the display, would not be readily perceived by the user with naked-eye. Yet, for users with discriminating perceptions, they may still sense the existence of such dark bands, which would cause dissatisfaction to the viewing quality, and the method of the present embodiment is provided to improve this problem.

In step 703, the inverter 501 is reset, and in step 705, a second potential signal is transmitted to the backlight module through the inverter 501 wherein the phase difference between the first and the second potential signals is 180 degrees.

Similarly to the embodiment described herein above in connection with FIG. 4, in this embodiment, the timing controller 520 controls the timing signal for transmitting the image signal to the display panel 202 and synchronously control the timing signal for resetting the inverter 501. Herein, the inverter 501 is designed to supply the second potential signal having a phase difference of 180 degrees with the first potential signal. Therefore, the voltage of the display panel 202 being interfered would have the waveform shown in FIG. 8C, wherein the signal wave is a negative sine wave corresponding to the positive sine wave as shown in FIG. 8A. Accordingly, at the time when the potential of the first potential signal is zero, the potential of the second potential signal has a maximum value. As such, the positions where the dark bands 223 of FIG. 8D reside are complementary to the positions of the dark bands 221 of FIG. 8B.

Also, the frequency of the timing signal of the image signal outputted to the display panel 201 by the timing controller is about 60 Hz to 120 Hz. Therefore, the interval between the image as shown in FIG. 8B and the image as shown in FIG. 8D is quite short, and hence, the brain of the user may perceive the image as shown in FIG. 8E due to the vision persistence of the user's eyes, where the brightness across the whole image seems to be uniform.

After that, in step 707, the inverter 501 is reset again, and in step 709, steps 701-707 are repeated.

In this embodiment, after the inverter 501 transmits the second potential signal to the backlight module 510, the display panel 202 will show the image as shown in FIG. 8D, which is resulted from the interference caused by the lamps 511-517 of the backlight module 510. Hence, according to the present embodiment, the timing controller 520 is synchronized with the timing signal of the outputted image signal and to control the reset of the inverter 501 correspondingly. Accordingly, the step returns to the step 701, where the inverter 501 supplies the first potential signal to the backlight module 510 again. Thus, users may continuously perceive the image with uniform brightness as shown in FIG. 8E by repeating the step 701-707. Also, the frequency of the alteration between the images of 8B and 8D is about 60 Hz to 120 Hz, hence, even users with highly discriminating eyes would have the vision persistence under this condition. Therefore, the user is not able to sense the presence of the dark bands 221 and 223. Moreover, the positions of the darks bands 221 and 223 are kept at fixed positions by repeatedly resetting the inverter 501, thereby, the dark bands would not move downward with time.

In view of the foregoing, the methods provided in the present invention may effectively reduce the interference caused by the potential signal from the inverter to backlight module. Additionally, a uniform brightness of the display image could be achieved by the present method in conjunction with the persistence of vision of the user's eyes.

Furthermore, the problem of flashover is avoided by not outputting the positive and negative-potential high voltage to adjacent lamps. More preferable, the present methods are suitable for use in any available display without using additional structures, thereby incurring no additional manufacturing cost.

While the embodiments of the present invention disclosed herein are presently considered to be preferred embodiments, various changes and modifications can be made without departing from the spirit and scope of the present invention. The scope of the invention is indicated in the appended claims, and all changes that come within the meaning and range of equivalents are intended to be embraced therein.

What is claimed is:

1. A method for reducing the ripple noise in the display image, comprising the steps of:

(a) supplying a first potential signal to a backlight module by an inverter;

(b) resetting said inverter;

(c) supplying a second potential signal to said backlight module by the inverter, wherein the phases of said first potential signal and said second potential signal are the same; and (e) repeating the steps (b) to (c).

2. The method according to claim 1, further comprising: providing a timing signal for resetting the inverter by a timing controller coupled to the inverter.

3. The method according to claim 2, wherein said step of resetting said inverter is synchronized by transmitting an image from said timing controller to a display.

4. The method according to claim 1, wherein said backlight module comprises a plurality of lamps for receiving said first potential signal and said second potential signal supplied from said inverter.

5. The method according to claim 1, wherein each of said first potential signal and said second potential signal is a sine wave signal.

6. A method for reducing ripple noise on the display image, comprising the steps of:

(a) supplying a first potential signal to a backlight module by an inverter;

(b) resetting said inverter;

(c) supplying a second potential signal to said backlight by the inverter, wherein the phase difference between said first potential signal and said second potential signal is fixed degrees;

(d) resetting said inverter again; and (e) repeating the steps (a) to (d).

7. The method according to claim 6, further comprising: providing a timing signal for resetting the inverter by a timing controller coupled to the inverter.

8. The method according to claim 6, wherein said backlight module comprises a plurality of lamps for receiving said first potential signal and said second potential signal supplied from said inverter.

9. The method according to claim 6, wherein said first potential signal is a sine wave signal.

10. The method according to claim 6, wherein said second potential signal is a sine wave signal having a phase difference of 180 degrees with respect to the first potential signal.

* * * * *